US006016937A

United States Patent [19]

Clay

[11] Patent Number: 6,016,937

[45] Date of Patent: Jan. 25, 2000

[54] DISPENSER APPARATUS

[76] Inventor: Charles L. Clay, 571 W. Miracle Strip Pkwy., Mary Esther, Fla. 32569

[21] Appl. No.: 09/065,388

[22] Filed: Apr. 23, 1998

[51] Int. Cl.[7] ..... B05B 9/047

[52] U.S. Cl. ..... 222/330; 222/387; 222/389; 239/322

[58] Field of Search ..... 222/389, 387, 222/330, 256, 262; 239/320, 322

[56] References Cited

U.S. PATENT DOCUMENTS

| | | | |
|---|---|---|---|
| 1,042,627 | 10/1912 | Watson | 222/389 |
| 1,578,944 | 3/1926 | Wilkinson | 222/262 |
| 1,604,434 | 10/1926 | Welch et al. | 222/389 |
| 1,704,623 | 3/1929 | McManamna | 222/262 |
| 2,433,506 | 12/1947 | Davis | 222/262 |
| 2,463,113 | 3/1949 | Klein | 222/262 |
| 3,231,147 | 1/1966 | Leahy | 222/262 |
| 4,116,368 | 9/1978 | Smith | 222/145 |
| 4,157,773 | 6/1979 | Schetier et al. | 222/203 |
| 4,376,498 | 3/1983 | Davis, Jr. | 222/326 |
| 4,735,509 | 4/1988 | Rausch | 366/333 |
| 4,821,927 | 4/1989 | Paulsca et al. | 222/263 |
| 4,871,088 | 10/1989 | Cox | 222/47 |
| 4,976,372 | 12/1990 | Rogers, Jr. | 222/389 |
| 5,058,769 | 10/1991 | Kurtz | 222/47 |
| 5,109,955 | 5/1992 | Clark | 222/330 |
| 5,224,629 | 7/1993 | Hsich | 222/137 |
| 5,226,575 | 7/1993 | Faust | 222/611.2 |
| 5,314,100 | 5/1994 | Deaver | 222/626 |
| 5,474,214 | 12/1995 | Chung et al. | 222/262 |
| 5,535,926 | 7/1996 | Blitz et al. | 222/324 |

*Primary Examiner*—Kevin Shaver
*Assistant Examiner*—David Deal
*Attorney, Agent, or Firm*—Peter Loffler

[57] ABSTRACT

A dispensing apparatus for delivering grout or other material, in either a single column or a plurality of spaced apart columns, is comprised of a body member having a pneumatic chamber with a pair of end caps attached to opposing ends. A piston is adapted to slide within the pneumatic chamber. A discharge nozzle having at least one discharge port is removably attached to one of the end caps. A control system controls fluid flow communication between the pneumatic chamber and the discharge nozzle. A pair of valves are attached to the end of the body member opposite the discharge nozzle end. One of the valves controls fluid flow communication between the pneumatic chamber and a source of pressurized gas while the other valve acts as an air relief valve.

16 Claims, 4 Drawing Sheets

DISPENSER APPARATUS

BACKGROUND OF THE INVENTION

1. Field of the Invention

The present invention relates to a pneumatic dispensing apparatus for dispensing grout and the like.

2. Background of the Prior Art

When tile is laid, grout is placed into the joints between adjacent tiles. The method typically employed to accomplish this task is to apply grout over the entire tile surface and then sponge the grout into the joints and thereafter wash the tile surface to remove excess grout. Such a method is slow, sometimes requiring multiple cleaning steps, and also wastes grout. Furthermore, some tiles are porous and grout is very difficult, if not impossible, to remove therefrom.

Therefore, there is a need in the art for a device that will simplify the application of grout into the tile joints. Such a device must be efficient in operation and must eliminate the need to clean the entire tile surface. Such a device should not waste grout and, will ideally, be of simple and straightforward design.

SUMMARY OF THE INVENTION

The dispensing apparatus of the present invention addresses the aforementioned needs in the art. The dispensing apparatus allows the grout to be dispensed directly into the tile joints eliminating the need to clean the entire tile surface and minimizing grout waste. The dispensing apparatus can also apply adhesive onto the surface onto which the tile is to be laid. This dispension of adhesive is quick and highly efficient.

The dispensing apparatus of the present invention is comprised of a body member having a pneumatic chamber. A first end cap having a first port is attached, threadably or otherwise, to an end of the body member and a second end cap having a second port is attached, also threadably or otherwise, to the opposing end of the body member. A discharge nozzle is attached, threadably or otherwise, to the first end cap such that fluid flow communication is possible between the pneumatic chamber and the discharge nozzle. The discharge nozzle may have a single discharge port for dispensing grout or may have a plurality of discharge ports for dispensing adhesive across a relatively large area. A control system comprised of a plunger adapted to slide within a channel disposed within the first end cap, a bracket pivotally attached to the first end cap, and a handle pivotally attached to the bracket and the plunger, controls fluid flow communication between the pneumatic chamber and the discharge nozzle. A piston, comprised of a spacer having a pair of cup washers, one each on opposing ends of the spacer, is adapted to slide within the pneumatic chamber in order to force grout out of the discharge nozzle upon the application of pneumatic force onto the piston. The second port of the second end cap is attached to a T-fitting, with one end of the T-fitting attached to a first control valve that removably connects, via a quick connection fitting, to a source of pressurized air or other gas, while another end of the T-fitting is attached to a second control valve which serves as a pressure control valve allowing air to be bled from the system.

The dispensing apparatus is relatively simple to use. Grout or other flowable material is placed into the device between the piston and the discharge nozzle and the device is connected to a pressurized air source and the first valve is opened and the second valve is closed. The handle is positioned so as to allow grout to be forced out through the discharge nozzle.

BRIEF DESCRIPTION OF THE DRAWINGS

Similar reference numerals refer to similar parts throughout the several views of the drawings.

DESCRIPTION OF THE PREFERRED EMBODIMENT

Figure 1:
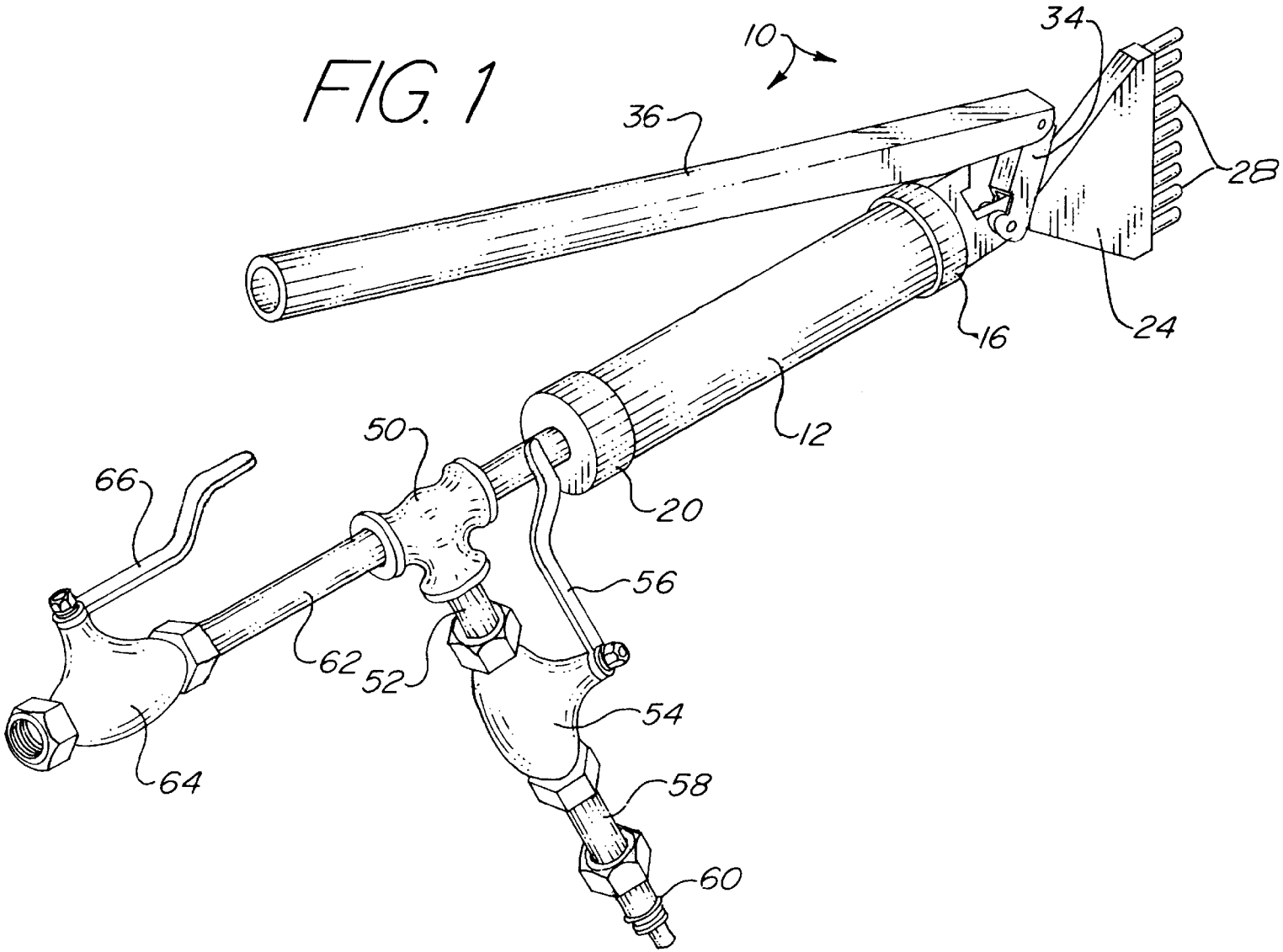
FIG. 1 is a perspective view of the dispensing apparatus of the present invention.
Figure 2:
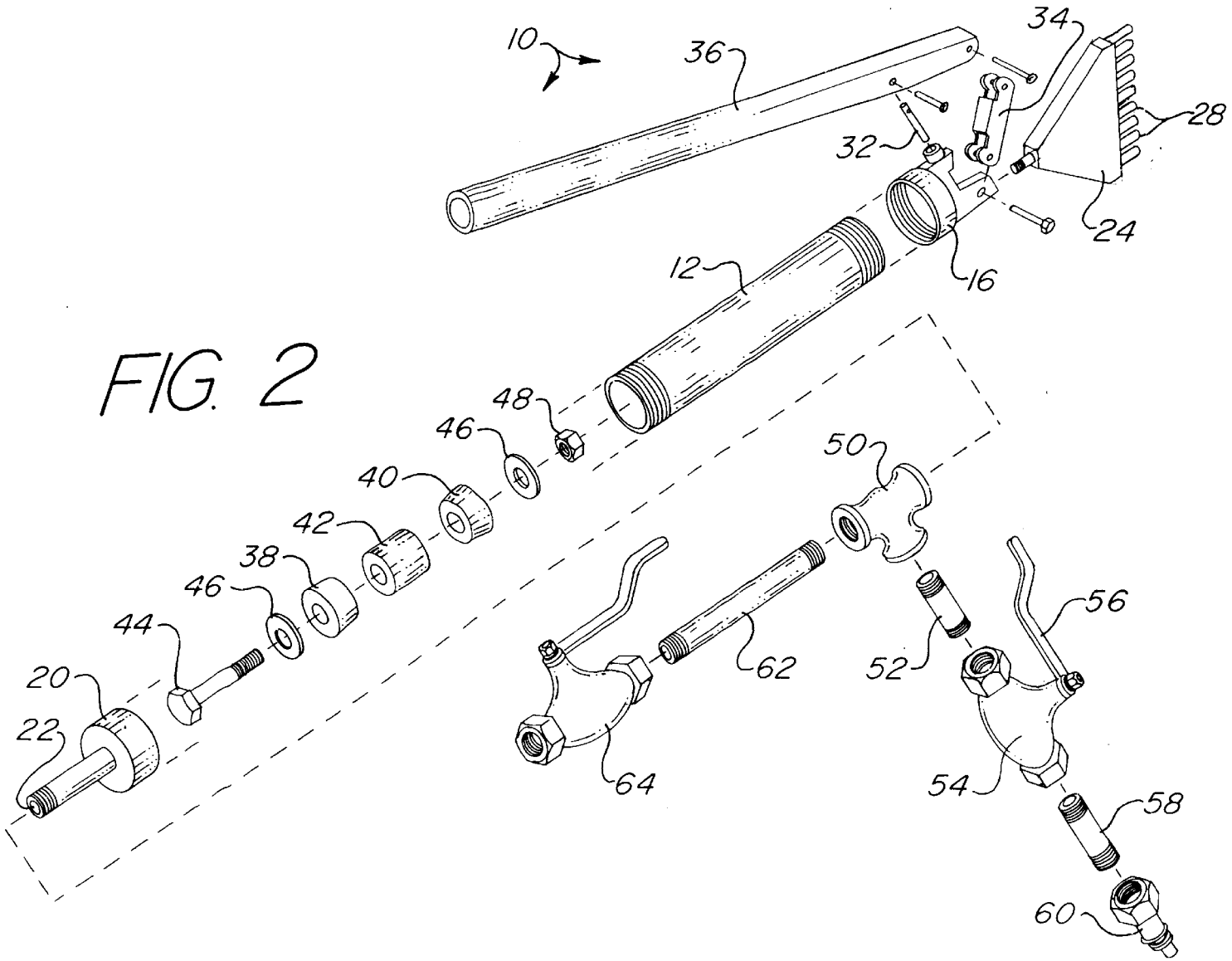
FIG. 2 is an exploded view of the dispensing apparatus.
Figure 3:
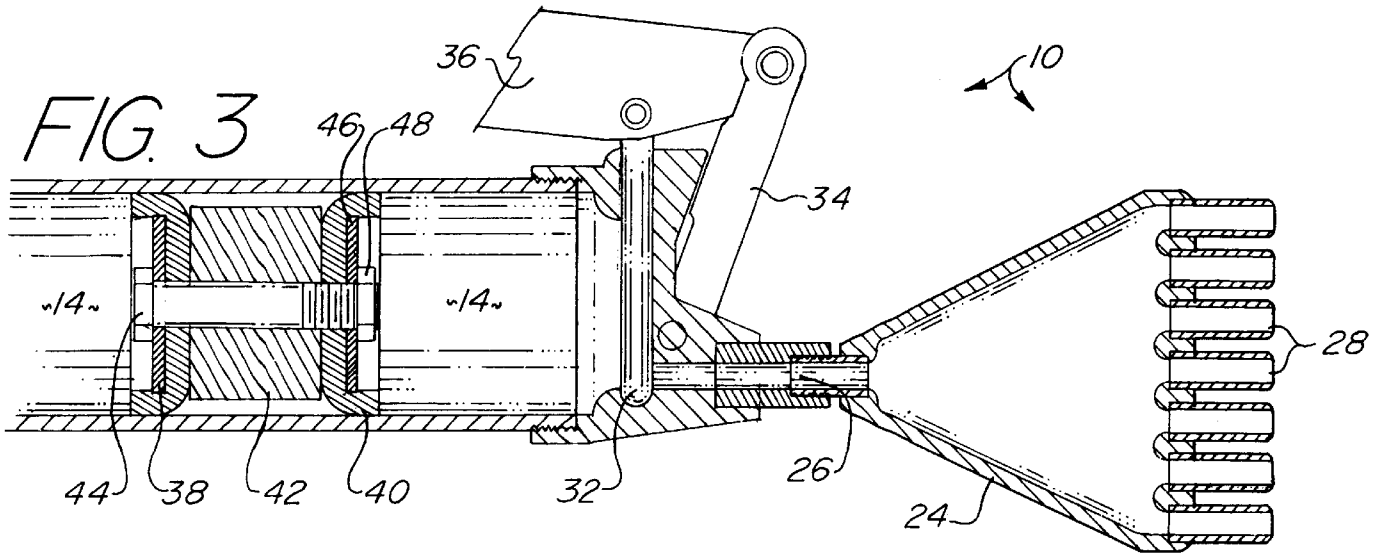
FIG. 3 is a partial cross-sectional view of the dispensing apparatus with the control system in a closed position.
Figure 4:
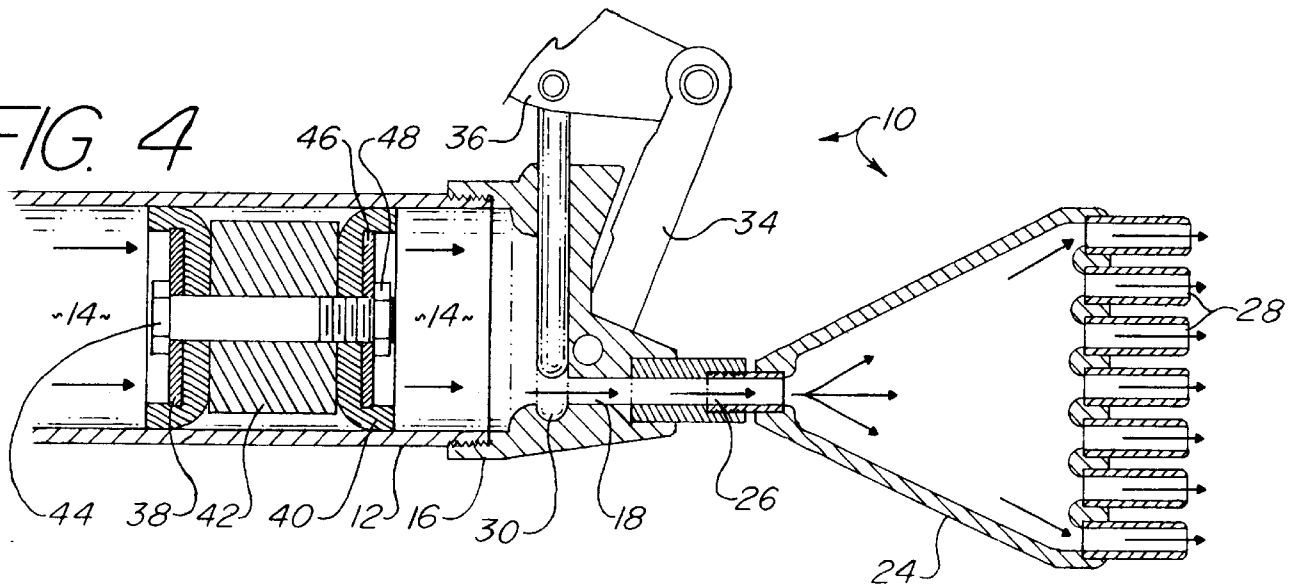
FIG. 4 is a partial cross-sectional view of the dispensing apparatus with the control system in an open position.
Figure 5:
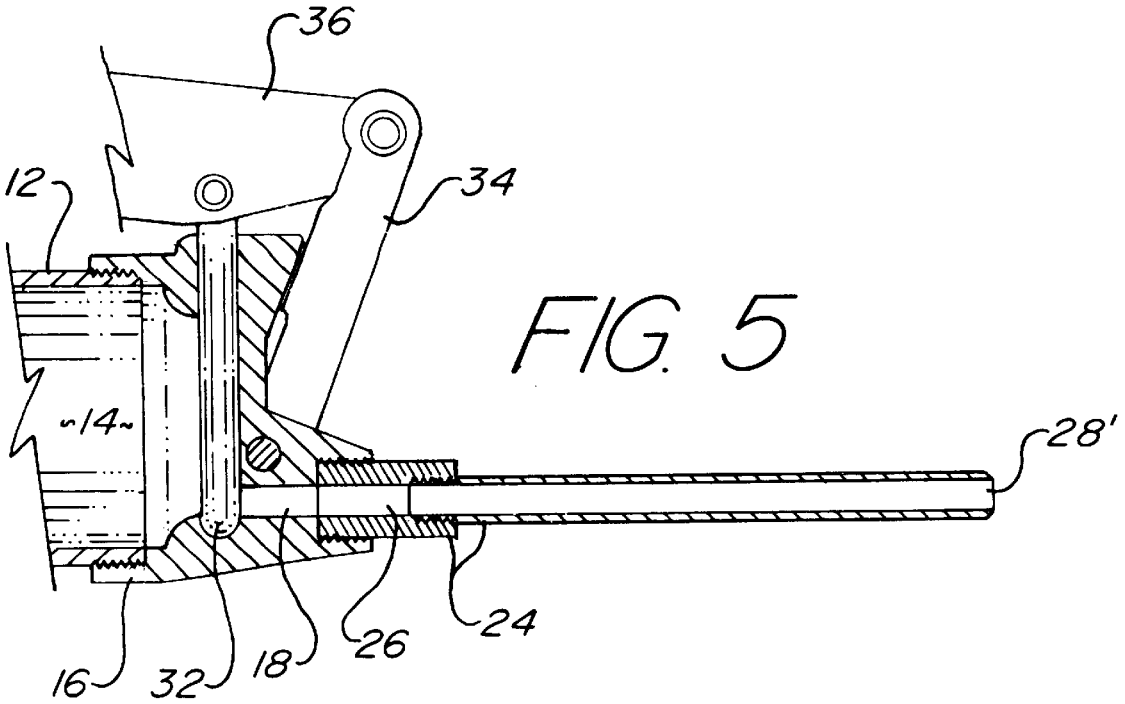
FIG. 5 is a partial cross-sectional view of the dispensing apparatus illustrating a single discharge port discharge nozzle utilizable with the dispensing apparatus of the present invention.

Referring now to the drawings, it is seen that the dispensing apparatus of the present invention, generally denoted by reference numeral 10, is comprised of a body member 12 having a pneumatic chamber 14. A first end cap 16 having a first port 18 is removably attached (threadably or otherwise) to the body member 12, while a second end cap 20 having a second port 22 is also removably attached (threadably or otherwise) to the body member 12 opposite the first end cap 16. A discharge nozzle 24 has a first port 26 and is removably attached (threadably or otherwise) to the first end cap 16 such that the first port 18 of the first cap 16 aligns with the first port 26 of the discharge nozzle 24. This establishes a fluid flow communication path between the pneumatic chamber 14 and the discharge nozzle 24. As seen in FIGS. 1–4, the discharge nozzle 24 may have a plurality of discharge ports 28, or as seen in FIG. 5, the discharge nozzle 24 may have a single discharge port 28'. A control system controls the fluid flow communication between the pneumatic chamber 14 and the discharge nozzle 24 and is articulatable between an open position permitting fluid flow communication and a closed position preventing fluid flow communication. The control system is comprised of a channel 30 disposed within the first end cap 16, and a plunger 32 slidably disposed within the channel 30. A bracket 34 has one end pivotally attached to the first end cap 16 while the other end is pivotally attached to a handle 36, the handle 36 also being pivotally attached to the plunger 32. When the handle 36 is positioned relatively close to the body member 12, the plunger 32 is fully disposed within the channel 30 (illustrated in FIG. 3) with the plunger 32 preventing fluid flow communication between the pneumatic chamber 14 and the discharge nozzle 24. When the handle 36 is lifted upwardly away from the body member 12, the plunger 32 is partially raised out of the channel 30 (illustrated in figure) thereby establishing ht e fluid flow communication path between the pneumatic chamber 14 and the discharge nozzle 24.

A piston is disposed within the pneumatic chamber 14 and is adapted to slide within the pneumatic chamber 14. The piston is comprised of a first cup washer 38 and a second cup washer 40 separated by a spacer 42. An appropriate bolt 44 with attendant washers 46 and nut 48 holds the piston together. Upon application of pneumatic force onto the first cup washer 38, the piston slides within the pneumatic chamber 14 with the second cup washer 40 forcing material (such as grout) through the pneumatic chamber 14 and out through the discharge nozzle 24. The spacer 42 assures that the piston does not become misaligned within the pneumatic chamber 14.

The second end cap 20 is attached to a T-fitting 50. An end of the T-fitting 50 is connected, via an appropriate nipple 52 to a first control valve 54 having a control lever 56. The first valve 54 is attached, via an appropriate nipple 58, to a quick connection fitting 60 which is itself attached to a source of pressurized air. Another end of the T-fitting 50 is attached, via an appropriate nipple 62, to a second control valve 64 having a second control lever 66. This second valve 64 allows air pressure to be bled from the dispensing apparatus 10. Both the first valve 54 and the second valve 64 can be of any appropriate design such as a ball valve, a globe valve, etc.

In order to utilize the dispensing apparatus 10 of the present invention, the first end cap 16 is removed from the body member 12 and grout or other viscous material such as adhesive etc., is placed into the pneumatic chamber 14 such that it rests against the second cup washer 40. With the control system in a closed position, the first end cap 16 is reattached to the body member 12. An appropriate discharge nozzle 24 is attached to the first end cap 16. The quick connection fitting 60 is attached to a source of pressurized air. The first valve 54, via the first lever 56, is placed into an open position while the second valve 64, via the second lever 66, is placed into a closed position. This introduces the pressurized air onto the first cup washer 38 and applies a pneumatic force thereonto. The control system is placed into an open position which causes the piston to force the grout or other material into the discharge nozzle 24 and out through the discharge port 28' or ports 28.

In order to terminate device 10 usage, the control system is placed into the closed position, the first valve 54 is paced into the closed position and the air pressure is discharged from the device 10 by opening the second valve 64. The quick connection fitting 60 is removed from the pressurized air source.

While the invention has been particularly shown and described with reference to an embodiment thereof, it will be appreciated by those skilled in the art that various changes in form and detail may be made without departing from the spirit and scope of the invention.

I claim:

1. A dispensing apparatus comprising:

a body member having a pneumatic chamber, a first end cap with a first port attached to the body member;

a second end cap with a second port attached to the body member;

a discharge nozzle, in fluid flow communication with the pneumatic chamber, attached to the first end cap;

a control system, attached to the first end cap, operable between an open position permitting fluid flow communication between the pneumatic chamber and the discharge nozzle and a closed position preventing fluid flow communication between the pneumatic chamber and the discharge nozzle;

a piston adapted to slide within the pneumatic chamber;

a T-fitting, having a first end in fluid flow communication with the pneumatic chamber, a second end, and a third end, attached to the second end cap;

a first valve having a fourth end attached to the second end and a fifth end; and a second valve having an sixth end attached to the third end and a seventh end.

2. The dispensing apparatus as in claim 1 wherein the discharge nozzle has a third port connected to the first port and a fourth port.

3. The dispensing apparatus as in claim 1 wherein the discharge nozzle has a third port connected to the first port and a plurality of fourth ports.

4. The dispensing apparatus as in claim 1 wherein the discharge nozzle is removably attached to the first end cap.

5. The dispensing apparatus as in claim 1 wherein the discharge nozzle is threadably attached to the first end cap.

6. The dispensing apparatus as in claim 1 wherein the control system comprises:

a channel disposed within the first end cap;

a plunger adapted to slide within the channel;

a bracket having an eight end pivotally attached to the first end cap, and a ninth end; and a handle pivotally attached to the ninth end and pivotally attached to the plunger.

7. The dispensing apparatus as in claim 1 wherein the first end cap is removably attached to the body member.

8. The dispensing apparatus as in claim 1 wherein the first end cap is threadably attached to the body member.

9. The dispensing apparatus as in claim 1 wherein the second end cap is removably attached to the body member.

10. The dispensing apparatus as in claim 1 wherein the second end cap is threadably attached to the body member.

11. The dispensing apparatus as in claim 1 wherein the piston is comprised of:

a spacer; and a pair of cup washers each attached to an opposing end of the spacer.

12. The dispensing apparatus as in claim 1 wherein the first valve is a globe valve.

13. The dispensing apparatus as in claim 1 wherein the first valve is a ball valve.

14. The dispensing apparatus as in claim 1 wherein the second valve is a globe valve.

15. The dispensing apparatus as in claim 1 wherein the second valve is a ball valve.

16. The dispensing apparatus as in claim 1 further comprising a connection fitting, attached to the fifth end, adapted to be removably attached to a pressurized gas source.

* * * * *